United States Patent [19]

Sanders

[11] 4,328,627

[45] May 11, 1982

[54] ADJUSTABLE SKATING SHOE

[76] Inventor: Glen D. Sanders, 1372 Sierra Alta Dr., Tustin, Calif. 92680

[21] Appl. No.: 971,528

[22] Filed: Dec. 20, 1978

[51] Int. Cl.[3] ..... A43B 5/04; B62D 0/00

[52] U.S. Cl. ..... 36/115; 36/134; 280/87.04 A

[58] Field of Search ..... 36/115, 132, 134, 62; 280/87.04 A, 11.27, 87.03

[56] References Cited

U.S. PATENT DOCUMENTS

| | | | |
|---|---|---|---|
| 310,923 | 1/1885 | Wardwell | 36/115 |
| 3,235,978 | 2/1966 | Hyde | 36/115 |
| 4,107,856 | 8/1978 | Bourque | 36/115 |
| 4,150,499 | 4/1979 | Wang | 36/115 |

*Primary Examiner*—Patrick D. Lawson

*Attorney, Agent, or Firm*—Knobbe, Martens, Olson, Hubbard and Bear

[57] ABSTRACT

A skating shoe including a rigid structural member embedded within the sole of the shoe which permits the selective mounting of one or more wheel truck assemblies throughout the length of the shoe. The embedded beam design provides a rigid soled skate shoe having a low center of gravity which increases skating maneuverability and facilitates the use of a single mount truck and wheel assembly hanger. A plurality of attachments are additionally provided which allow the shoe to be utilized in ice skating, mountain climbing, and skiing applications.

27 Claims, 10 Drawing Figures

Fig. 3
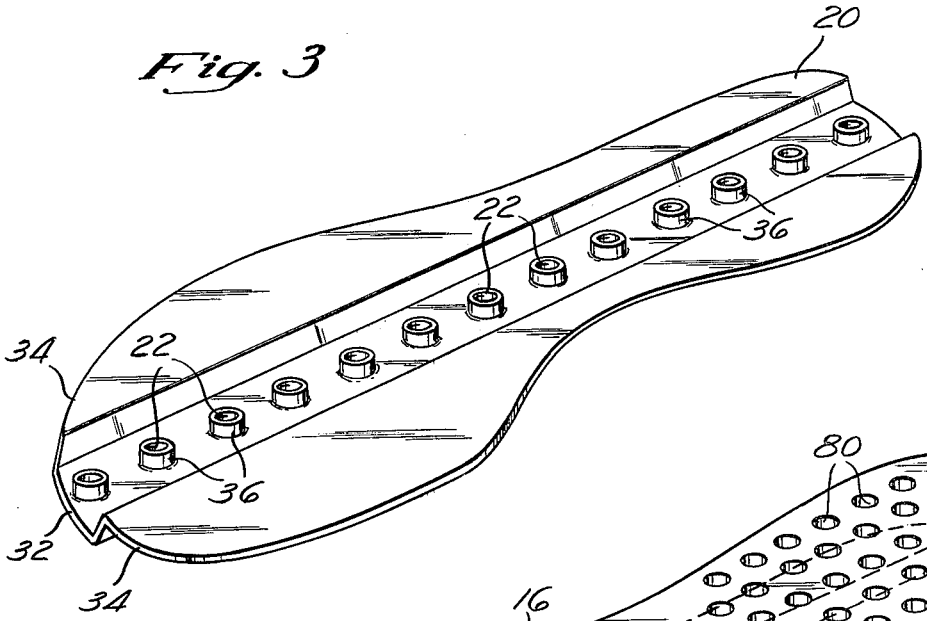
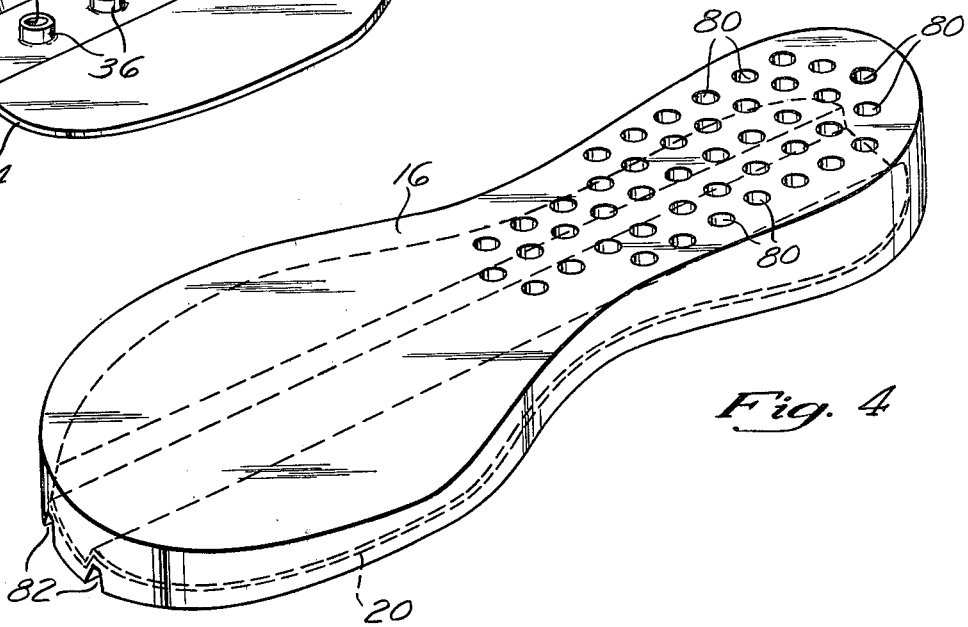
Fig. 4
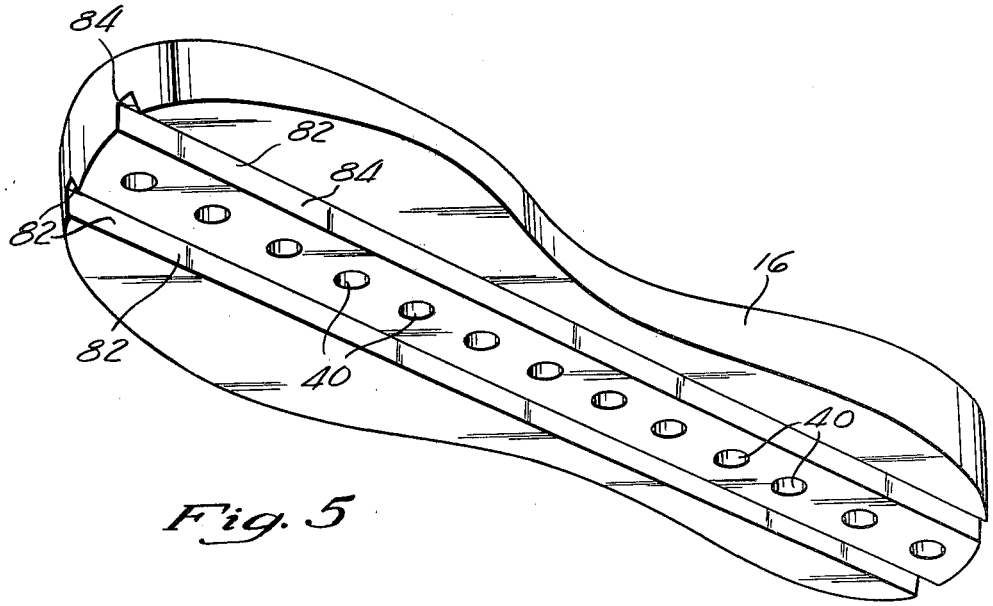
Fig. 5

ADJUSTABLE SKATING SHOE

BACKGROUND OF THE INVENTION

The present invention relates to skating apparatus and more particularly to roller skating apparatus wherein the position of the truck and wheel assemblies on the skate may be infinitely adjusted along the length of a rigid support member embedded within the sole of the shoe.

In recent years, there has been a dramatic resurgence in public interest and participation in roller skating, prompted primarily by the development of polyurethane wheels and improved truck and bearing assemblies which have provided new dimensions of speed and maneuverability to the sport. The vast scope of the resurgence in this rather old and well known sport is evidenced by the construction and opening of numerous skating rinks around the country as well as the anticipated introduction of roller figure skating in future Pan American and Olympic games.

In response to this resurgence, there has been an increasing public demand for more sophisticated roller skating equipment suitable for use in competitive speed skating, figure skating, and trick or stunt skating applications. In particular, there exists a need for a roller skate shoe which is rigid in nature possessing a low center of gravity to aid in maneuverability, is provided with an adjustment means whereby the truck and wheel assemblies may be positioned at the most advantageous position for the particular user, and may be modified to receive one or more truck or wheel assemblies for stunt or trick skating applications. Further, the purchasing public requires such a roller skate shoe including all of the above features to additionally be light weight and comfortable to wear as well as esthetically pleasing.

Presently, most roller skate shoes are constructed from a boot member, typically including a flexible sole and heel, onto which is securely mounted a rigid beam extending approximately one to two inches below the sole of the boot. This beam securely mounts a pair of truck and wheel assemblies to the boot as well as a toe stop adjacent the front end thereof. Although these prior art shoe skates provide a significant improvement over the original metal wheel and frame clamp-on skating devices and have proven useful in their limited application, they fail to meet the more sophisticated demands made by the general public.

In particular, prior art shoe skates utilizing an externally mounted rigid beam which extends substantially below the sole of the shoe possess a high center of gravity which significantly hinders the user's maneuverability while upon the skates. Further, due to the prior art raised heel design, the arch section of the shoe located intermediate the heel and the toe tends to flex downward against the top surface of the rigid beam during use. This flexing of the sole may cause the bolts mounting the exterior beam to the sole of the shoe to loosen thereby further decreasing maneuverability and often posing a signification safety hazard to the user.

Additionally, the prior art skate shoes have typically been void of any means for adjusting the position of the wheel sets relative the length of the shoe and, as such, fail to compensate for the differing foot features of individual users. Although one prior art U.S. Pat. No. 310,923 issued to C. E. Wardwell, Jan. 20, 1885, has recognized to a limited extent the problems of providing an adjustable wheel set on the skate shoe, the degree of adjustability provided by the disclosed design is extremely limited, and the high center of gravity skate shoe required by the disclosed adjustment mechanism both present significant problems. As such, the prior art roller skate shoes have failed to provide a sophisticated skating apparatus and additionally have failed to meet the needs and demands of the purchasing public.

SUMMARY OF THE PRESENT INVENTION

The present invention provides a skate shoe including a rigid structural member or beam embedded within the sole of the shoe. This rigid beam is provided with a plurality of threaded apertures which permit one or more hanger and wheel assemblies to be mounted to the sole of the shoe at any location along the length thereof. By use of the embedded structural beam within the sole of the shoe, the effective center of gravity of the shoe is substantially lowered in comparison to the prior art skating devices, which is extremely beneficial for skating maneuverability and safety.

The sole of the skate shoe is formed in a wedge-like configuration, thereby allowing the embedded structural beam to lie flat along the lower surface of the sole and additionally providing complete support for the user's foot from the heel to the toe of the shoe. By embedding the structural beam within the sole of the shoe, the beam additionally becomes a co-extensive unit with the shoe, thereby eliminating any possibility of relative movement between the sole of the shoe and the support beam and the safety hazards associated therewith.

Further, the infinite adjustability of the wheel assemblies along the length of the shoe allows the shoe skate to be finally adjusted to precisely fit the foot of the particular user. In addition, the shoe may be provided with multiple wheel assemblies to accommodate roller skating tricks or stunt applications. As such, the shoe skate of the present invention significantly eliminates the maneuverability, adjustability, and safety deficiencies associated with the prior art shoe skate designs.

The present invention further provides one or more attachments which may be securely mounted to the embedded structural member adjacent the toe and heel portion of the shoe which permit the shoe to be utilized in ice skating, mountain climbing or skiing applications. Prior art designs allowing such interchangeability typically utilize external beams or strengthening members when rigidity from toe to heel is required for a given application, and thus exhibit the difficulties mentioned previously.

In addition, a novel ankle support is disclosed which may be easily positioned onto the upper portion of the boot, snapped and laced therein to provide increased ankle support for a user.

These and other features of the present invention will become more apparent upon reference to the drawings wherein:

FIG. 3 is an enlarged perspective view of the rigid strengthening member of the present invention removed for illustration from the sole of the shoe;

FIG. 4 is a perspective view of the wedge sole of the present invention having the upper boot portion of the shoe removed therefrom and illustrating the spacial relationship of the rigid structural member embedded therein;

FIG. 5 is a perspective view of the lower surface of the wedge sole of FIG. 4;

DETAILED DESCRIPTION OF THE PREFERRED EMBODIMENT

Figures 1, 2:
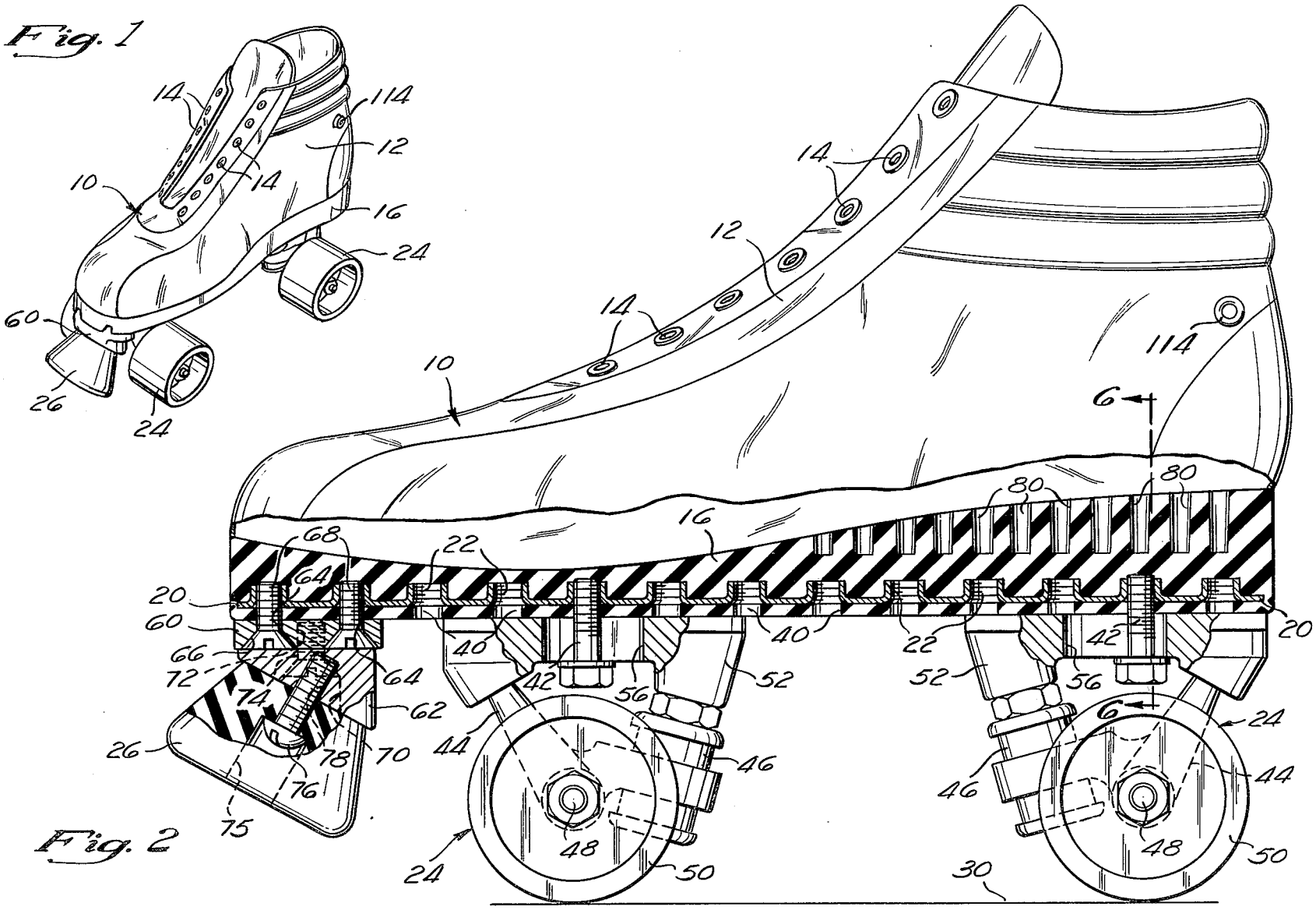
FIG. 1 is a perspective view of the skate shoe of the present invention having a pair of hanger and wheel assemblies attached thereto.
FIG. 2 is an enlarged side elevation view, partially in section, of the skate shoe of FIG. 1, illustrating the rigid structural member embedded within the sole of the shoe and the interconnection of the hanger and wheel assemblies thereto.

Referring to FIGS. 1 and 2, there is shown a skate shoe 10 of the present invention including an upper shoe or boot portion 12 having a plurality of lacing apertures 14 formed thereon and a wedge-shaped sole 16 attached in a conventional manner to the bottom portion 12. The wedge-shaped sole 16 is provided with a rigid structural member 20 which is embedded within and extends throughout the length of the sole 16 adjacent the lower surface thereof.

As will be explained in more detail infra, this rigid structural member or beam 20 is provided with a plurality of threaded apertures 22, which are selectively accessible from the lower surface of the sole 16, to facilitate the mounting of one or more truck and wheel assemblies 24 at any location along the length of the sole 16. A toe stop 26 is additionally mounted to the rigid structural member 20 and is preferably positioned adjacent the toe end of the skate shoe 10.

As will become more apparent, by use of the embedded structural member design, the skate shoe 10 of the present invention possesses an extremely low profile, having the lower surface of the sole 16 minimally spaced from the skating or support surface 30. The low profile design of the present invention significantly lowers the center of gravity of the skate shoe 10, thereby increasing the user's control and maneuverability while skating.

As shown, in the preferred embodiment, the structural member 20 is embedded throughout the length of the sole 16 and is oriented parallel to and spaced approximately ⅛-inch above the lower surface of the sole 16. As better shown in FIGS. 3 and 6, the structural beam 20 typically formed from steel plate material and possessing exterior dimensions slightly less than the wedge sole 16 is preferably fabricated having a gull-wing cross-sectional configuration, including a lower keel portion 32 and a pair of flanges 34 which extend angularly upward and laterally outward from the keel 32.

Symmetrically spaced along the length of the beam 20, initiating from the top of the keel section 32 and extending to the approximate height of the flange sections 34 are a plurality of bosses 36 having a threaded aperture 22 formed therein. These bosses 36 and apertures 22 are oriented normal to surface of the keel section 32 as well as the lower surface of the sole 16, to provide a fastening means for the mounting of the truck and wheel assemblies 24 and the toe stop 26.

As will be recognized, the structural member 20 lends itself to economical production techniques wherein the beam 20 may be stamped and cold formed from sheet metal material so that the gull-wing cross-section and raised bosses 36 are pressed therein with the apertures 22 being subsequently threaded by any of the well known tapping procedures. The applicant has found that this particular gull-wing design of the preferred embodiment provides a light weight, high strength structural member 20, which, due to the flange sections extending substantially across the width of the sole 16, is conducive to being embedded or encapsulated within the sole 16 of the shoe. The substantial surface area of the member 20, and especially the flanges 34, permits a strong bond to be developed between the material from which the sole 16 is formed and the member 20. However, it should be noted that alternative cross-sectional designs of the structural member 20 may be utilized without departing from the scope of the present invention.

Referring again to FIG. 2, it may be seen that the lower surface of the sole 16 is preferably provided with a series of apertures 40 which are disposed along a common center line with the apertures 22 of the structural member 20. These apertures 40 are aligned with and allow access to the threaded apertures 22 of the structural member 20. In the preferred embodiment, the apertures 22 have an outside diameter slightly less than the inside diameter of the threaded aperture 22, such that a thin section of the sole material covers or encapsulates the walls of the threaded aperture 22.

This thin layer or covering protects the unused threaded apertures 22 from degradation caused by exposure to moisture and additionally prevents dirt accumulation therein. The applicant has found that, by designing this layer to be extremely thin, a fastener 42 utilized to mount the truck and wheel assemblies 24 may be threaded directly into the aperture 22, with the thin layer being displaced from the area of the intermeshing threads.

The particular interconnection and design of the truck and wheel assemblies 24 and toe stop 26 with the rigid beam 20 may now be described. As shown in FIG. 2, the truck and wheel assemblies (designated generally by the numeral 24), are constructed in a well known manner and include a truck member 44, resilient suspension means 46, wheel bearing and axle 48 and wheels 50. However, in the preferred embodiment, the present invention provides a novel hanger 52 which is adapted to securely mount the truck and wheel assemblies 24 to the rigid beam 20.

Figure 7:
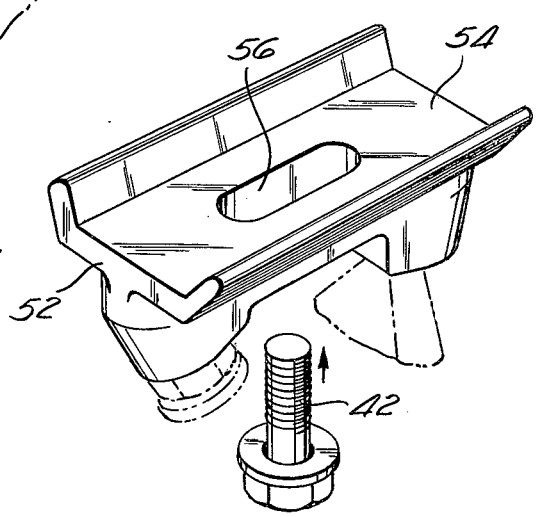
FIG. 7 is an enlarged perspective view of the wheel hanger of the present invention, illustrating the detailed construction thereof.

The hanger 52, preferably formed of die cast aluminum, cooperates with the truck member 44 and the suspension means 46 in a typical manner whereby a ball and socket joint (not shown) allows the truck to moderately pivot within the hanger 52. As better shown in FIG. 7, the hanger 52 includes a generally C-shaped channel 54 which extends along the top surface thereof and is additionally provided with an elongate aperture or slot 56 which is disposed intermediate the length thereof and extends vertically through the cross-section of the hanger 52. In the preferred embodiment, the length of this slot 56 is sized to be equal to or slightly greater than the distance between adjacent threaded apertures 22 on the rigid structural member 20 which, as will be described below, allows infinite adjustment of the position of the truck and wheel assemblies 24 along the length of the shoe 10.

Figure 6:
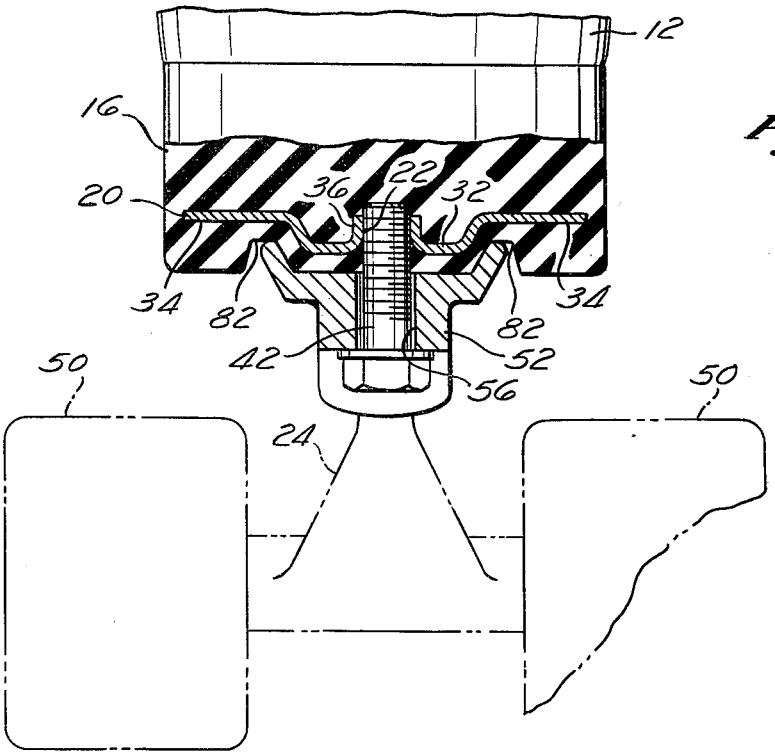
FIG. 6 is an enlarged rear elevation view, partially sectioned, along lines 6—6 of FIG. 2 illustrating the interface between the hanger assembly and the sole of the shoe of the present invention.

As may be easily recognized in FIG. 2, the hanger 52 is mounted to the rigid structural member 20 by a screw fastener or bolt 42 which is inserted through the elongate slot 56 of the hanger 52 and the apertures 40 of the sole 16 and is threaded into one of the apertures 22 of the rigid structural member 20. When mounted to the structural member 20, the C-shaped channel 54 of the hanger 52, resides within a pair of grooves 82 formed along the length of the sole 16 (as indicated in FIGS. 5 and 6) and is tightly abutted against the lower surface of the sole 16 such that any rotation of the hanger 52 about the axis of the screw fastener 42 is eliminated. As such, by use of the hanger 52 of the present invention, the truck and wheel assemblies 24 may be securely mounted to the shoe 10 by a single threaded fastener 42 which significantly reduces labor in assemblying the skating shoe, and additionally reduces the overall weight of the shoe structure.

As previously mentioned, since the length of the elongate slot 56 formed in the hanger 52 is preferably equal to or slightly greater than the spacing between adjacent threaded apertures 22, it will be noted that with the screw fastener 42 threaded into any given aperture 22, the lateral positioning of the hanger 52 may be varied to any position between adjacent threaded apertures by simply sliding the hanger 52 throughout the length of the slot 56. As such, the truck and wheel assemblies 24 possess infinite adjustability throughout the entire length of the skating shoe 10. This infinite adjustability allows the shoe skate 10 of the present invention to be finely adjusted to precisely fit the foot of the particular user. Additionally, this infinite adjustability allows either singular or multiple wheel sets 24 to be positioned on the skating shoe 10 at any desired location to accommodate various trick or stunt skating techniques.

In a similar manner, the toe stop 26 may be attached at a desired location along the length of the skate shoe 10, or may be completely removed from the sole 16 for stunt applications. As shown in FIG. 2, the toe stop 26, preferably formed of a rubber or soft plastic material, is rigidly attached to the structural member 20 of the sole 16 by use of a mounting plate 60 and wedge member 62.

The mounting plate 60 is formed having the same C-shaped upper flange design as the hanger member 52 and preferably includes two small apertures 64 having their center lines spaced to coincide with the center lines of adjacent threaded apertures 22 located along the rigid beam 20. The apertures 64 are additionally provided with a countersunk recess 66 adjacent one end thereof such that a pair of flush mounted screw fasteners 68 may be threaded into the apertures 22 to maintain the plate member 60 tightly against the bottom of the sole 16.

The wedge member 62 additionally includes a pair of countersunk apertures 70 which mate with a second pair of threaded apertures 72 formed in the plate member 60. As will be recognized, the common plane of the apertures 70 and 72 is oriented at approximately 90 degrees from the common plane of the apertures 64 of the plate member 60 and are spaced outboard (as viewed in FIG. 2) from a plane passing through the center lines of the apertures 64. As such, two countersunk screw fasteners 74 may be inserted through the apertures 70 of the wedge member 62 and threaded into the apertures 72 of the plate member 60, thereby securely mounting the wedge member 62 to the plate member 60.

The toe stop 26 may similarly be rigidly attached to the wedge member 62 by a threaded fastener 76 which extends through a bore 75 formed along the center line of the toe stop 26, and is threaded into a mating aperture 78 centrally formed in the wedge member 62. It will be noted that by this three component design (i.e., plate member 62, wedge 64, and toe stop 26), the toe stop 26 may be readily removed from the shoe skate 10 by simply removing the central screw fastener 76 from the wedge member 62 while the wedge member 62 and plate member 60 remain securely mounted to the sole 16 of the shoe 10. Additionally, it will be noted that this same design permits the use of standard prior art toe stops which aid in obtaining replacement components and reduces overall costs of the skate shoe.

Referring now to FIGS. 4 and 5, the detailed construction of the sole 16 of the present invention may be described. As shown, the sole 16, typically fabricated from rubber or a foamed plastic material, is formed having a generally wedge-shaped configuration wherein the thickness of the heel section is greater than the thickness of the toe section. The sole 16 includes the rigid support member 20 (indicated in phantom lines in FIG. 4) embedded or encapsulated within the interior thereof. In the preferred embodiment, the sole 16 is molded into its desired configuration with the structural member 20 serving as an insert which is placed directly within the cavity of the mold (not shown). As such, during the molding process, the sole material flows and cures tightly around the structural member 20, thereby providing a generally co-extensive integral structure.

As shown in FIG. 4, the upper surface of the sole 16 along the heel section thereof, is preferably provided with a series of apertures 80 which extend substantially through the thickness of the sole 16. These apertures 80 are closely spaced to provide the heel section of the sole 16 with a waffle-like cushion structure which the applicant has found provides substantial comfort and significantly eliminates foot fatigue during use. Additionally, the applicant has discovered that by use of the wedge-shaped design of the sole member 16, the weight of a user is automatically shifted from the heel section of the sole 16 to the ball section of the sole which is conducive to proper skating techniques.

Referring now to FIG. 5, the undersurface of the sole 16 of the present invention may be seen. As previously mentioned, the undersurface of the sole 16 includes a plurality of apertures 40 formed therein which extend throughout the length of the sole 16 and are aligned with the apertures 22 of the strengthening member 20 embedded within the sole 16. A pair of elongate grooves 82 preferably having angularly inclined sidewalls 84 extend throughout the length of the sole 16 and are disposed outboard on either side of the aperture 40. As previously mentioned, these grooves 82 cooperate with the C-shaped channel 58 formed on the hangers 52 (shown in FIG. 2) to eliminate any rotation of the hanger about the axis of screw fasteners 42 (shown in FIG. 2). Additionally, these grooves 82 form a registry means whereby, upon placement of the hangers 52 therein, the elongate slot 56 is disposed centrally above the apertures 40 of the sole 16.

With the structure of the rigid beam 20, sole 16, and hanger 52 defined, the detailed operation of this specific singular mount clamping feature of the present invention may be described. Referring to FIG. 6, the hanger 52 is shown abutted against the lower surface of the sole 16, having its C-shaped channel 58 extending within the grooves 82 formed along the bottom of the sole 16. In this position, the fastener 42 may be inserted upward through the aperture 56 (as indicated by the arrow in FIG. 7) and be threaded into the aperture 22 of the structural member 20 embedded within the sole 16.

As the fastener 42 is threaded therein, the interior surfaces of the C-channel 58 contact the exterior surfaces of the sole 16 disposed between the pair of grooves 82. Continued threading or tightening of the fastener 42 into the threaded aperture 22 causes the rubber sole material lying between the upper surfaces of the C-channel 58 and lower surfaces of the structural member 20 to be placed in compression. Due to the common mating surface configurations of the channel 58 and structural member 20, and the elastomeric nature of rubber, this compression aids in preventing the fastener 42 from backing out (loosening) from the aperture 22, and additionally reduces the thickness of the rubber between the beam 20 and channel 58 to insure a substantially rigid interface between the C-channel 58 and the rigid strengthening member 22. As such, relative movement between the hanger 52 and sole 16 is substantially eliminated, regardless of the selected location of the hanger 52 along the member 22, which is conductive to high maneuverability upon the skates.

The applicant has found that by use of the C-channel single mounting hangers of the present invention, a user may conveniently store a variety of differing sized wheel sets on individual hanger members and may rapidly mount the particular sized set upon the shoe. This interchangeability of the wheel sets allows the more sophisticated user the versatility of selecting the most advantageous wheel size for the particular style of rollerskating desired. Additionally, the applicant has found that in those few instances where the threaded aperture 22 becomes stripped due to overtightening of the fastener 42, the user may selectively cut the upper surface of the sole 16 to form a recess above the particular stripped aperture and place a nut (not shown) directly therein. In such a manner, the fastener 42 may be threaded into the nut to securely mount the hanger 52 and reside below the top surface of the sole 16 so that the nut does not contact the user's foot.

As will be recognized, by the embedding of the rigid structural member 20 within the interior of the sole 16, the skate shoe 10 of the present invention provides a substantially rigid sole shoe or boot which is extremely suitable for other sporting fields. In particular, the applicant has discovered that the rigid boot design of the present invention may be easily adapted for use in ice skating, snow skiing, and mountain climbing applications wherein it is highly desirable, if not necessary, that the sole of the shoe or boot remain substantially flat or planar when worn by the user.

Figure 8:
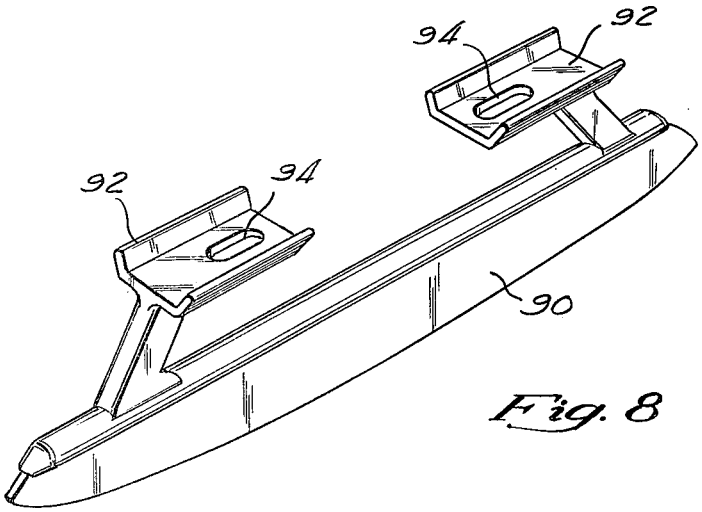
FIG. 8 is a perspective view of the ice skate attachment of the present invention, which may be mounted to the sole of the shoe.
Figure 9:
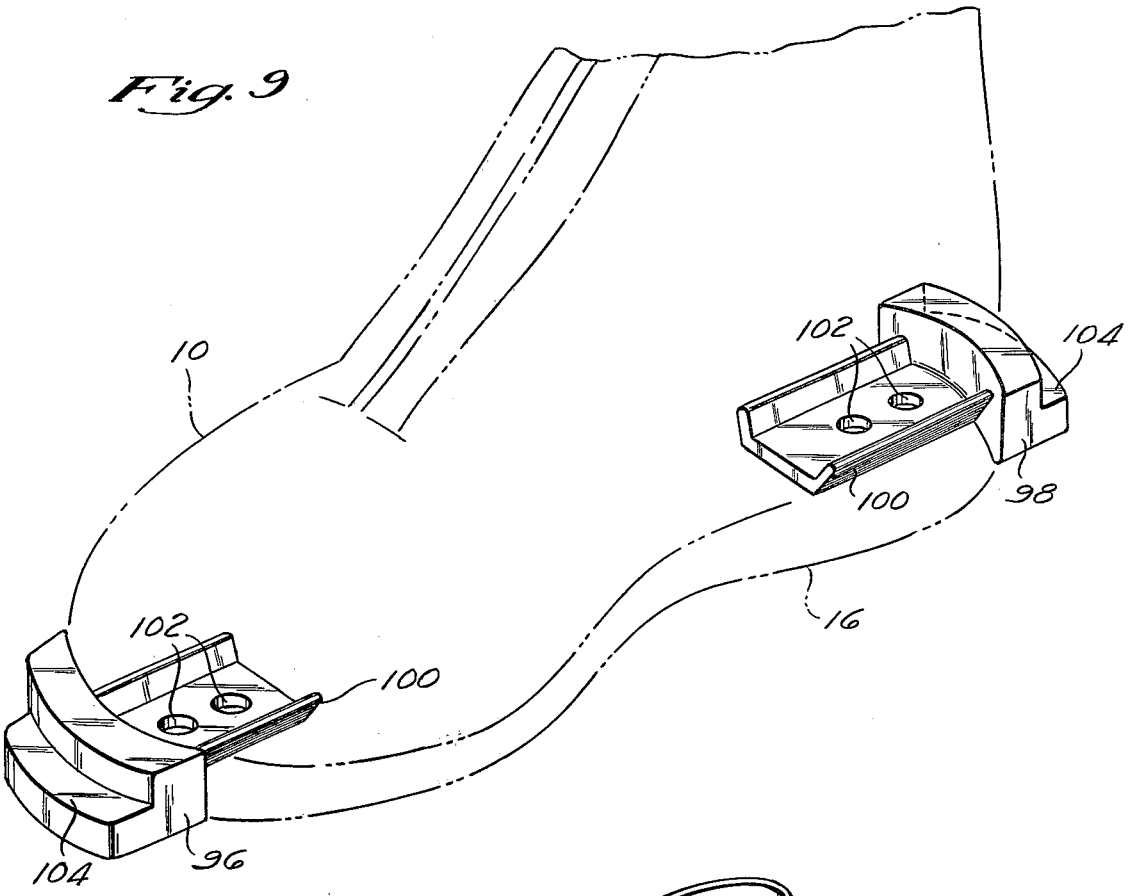
FIG. 9 is a perspective view of the heel and toe attachments suitable for modifying the shoe of the present invention for snow skiing applications.

Referring to FIGS. 8 and 9, the apparatus for modifying the boot 10 of the present invention to be utilized in ice skating and snow skiing, respectively, is illustrated. As shown in FIG. 8, a conventional ice skating blade 90 may be rigidly attached to a pair of C-shaped channel member 92 which extend vertically above the top surface of the blade 90. The pair of C-channels 92 are preferably formed having the same configuration as the C-channel 58 of the hanger member 52 (shown in FIG. 7) such that both of the channel members 92 may be securely mounted to the lower surface of the sole 16 in the manner depicted and previously described in relation to FIG. 6. As will be recognized, by such a modification, the skate shoe 10 of the present invention may be readily utilized for ice skating applications.

Further, it will be noted that by including the elongate aperture 94 on each of the C-channel members 92, the position of the blade 90 with respect to the boot may be adjusted along the length of the sole 16, with the only limitation being that both channel members 92 reside substantially beneath the sole 16. However, as will be recognized, this limitation may be substantially eliminated by attaching the channel members 92 to the blade 90 such that the distance or span between the apertures 94 is minimal.

Referring now to FIG. 9, the modification of the skate shoe 10 of the present invention to accommodate snow skiing applications is illustrated. In this embodiment, toe and heel pieces 96 and 98, respectively, each having a C-channel 100 extending therefrom, are securely mounted to the sole 16 in a manner previously described. However, in this particular embodiment, to accommodate the high forces generated during skiing which tend to separate the C-channel from the sole 16, a pair of threaded fasteners (not shown) extend through the pair of apertures 102 located in each of the C-channels 100 and are utilized to attach each of the toe and heel pieces 96 and 98 to the sole 16.

Preferably, the toe and heel members 96 and 98 are formed having a generally curved external configuration which coincides with the curvature of the boot 10 adjacent the toe and heel and include a reduced thickness section 104 along their outer extremities. This reduced thickness section 104 is received by the ski bindings (not shown) which are attached to the ski (not shown) and positively clamp the boot 10 to the ski (not shown).

As will be recognized, when modified to include the ski binding members 96 and 98, the C-channel 100 which extends slightly below the sole 16 causes the lower surface of the sole 16 to be slightly raised from the top surface of the ski (not shown). The applicant has found that in most instances, this slight raising of the sole 16 from the surface of the ski is not detrimental to ski performance. However, when desired, a small spacer (not shown) may be inserted between the interior ends of the C-channels 100 to provide a rigid support surface and eliminate the space formed between the sole 16 and the top surface of the ski (not shown). Thus, it will be recognized that by simply attaching the toe and heel members 96 and 98 to the sole 16, the shoe 10 of the present invention provides an effective ski boot suitable for the majority of snow skiing applications.

Figure 10:
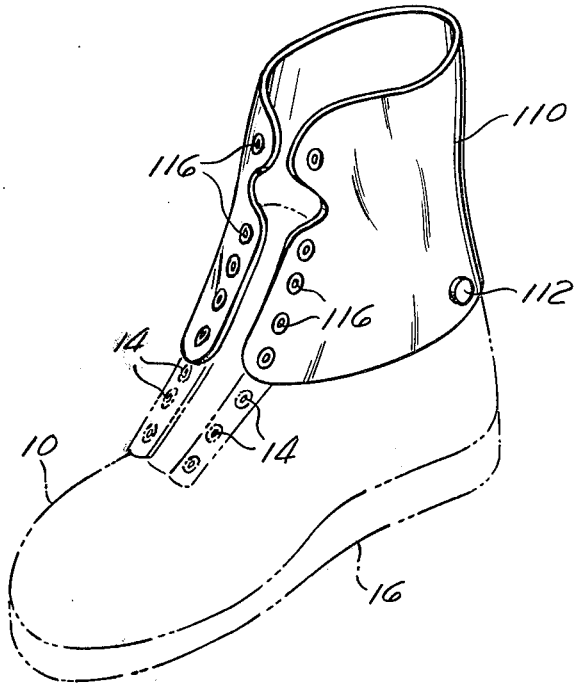
FIG. 10 is a perspective view of the ankle support member mounted to the upper portion of the shoe skate.

The present invention additionally includes a novel ankle support which may be quickly and easily attached to the upper portion of the shoe 10 to provide additional support for the ankle of the user. Referring to FIG. 10, it may be seen that the ankle support 110, preferably formed of a leather or fabric material, may be attached to the upper portion of the shoe 10 and extends vertically to wrap around the ankle of a user (not shown).

The ankle guard is preferably provided with a pair of snap members 112 positioned adjacent the lower end thereof which mate with a pair of snap fasteners 114 located on the upper heel section of the shoe 10 (as shown in FIGS. 1 and 2). A plurality of lacing eyelets 116 are additionally provided adjacent opposite ends of the support member 110 and advantageously coincide with the eyelets 14 formed on the shoe itself.

Thus, as will be recognized by mating the snap members 112 and 114, the ankle member 110 wraps around the ankle of a user and may be tightened thereabout by extending a shoelace (not shown) through the eyelets 114 and 116. As such, the ankle support 110 provides an extension for the boot 10 which provides additional support for the ankle of the user.

Thus, from the above description, it may be easily understood that the present invention provides a novel shoe skate apparatus which allows infinite adjustability of the locations of the wheel sets along the length of the shoe, possesses a low profile design which significantly lowers the effective center of gravity of the shoe, and facilitates easy interchangeability of wheel sets by the user which heretofore was unobtainable in prior art shoe skate apparatus.

I claim:

1. A sport shoe adapted to be worn upon the foot of a user comprising:

a foot receiving member;

a resilient sole member attached to said foot receiving member;

a structural beam disposed between opposite surfaces of said sole member and extending along the length of said sole member;

means disposed on said sole member for contacting a support when said shoe is worn by a user; and means for selectively attaching said contacting means to said structural beam at plural positions located along the length of said structural beam.

2. The sport shoe of claim 1 wherein said structural beam extends throughout the length of said sole member.

3. The sport shoe of claim 1 wherein said sole member includes means formed along the lower surface of said sole member for registering said contacting means with said structural beam.

4. The sport shoe of claim 3 wherein said registry means comprises a pair of grooves extending throughout the length of said sole member, said grooves receiving a channel member formed along one surface of said contacting means.

5. The sport shoe of claim 1 wherein said attaching means comprises a plurality of threaded apertures symmetrically spaced along the length of said structural beam.

6. The sport shoe of claim 5 wherein said sole member includes a plurality of access apertures aligned with each of said threaded apertures spaced along the length of said structural beam.

7. The sport shoe of claim 1 wherein said structural beam is molded within the interior of said sole member.

8. A shoe skate comprising:

a shoe including an upper portion and a substantially rigid sole;

skating means disposed beneath and attached to said sole;

channel means formed along the lower surface of said sole cooperating with said skating means to register said skating means against rotation at any selected position along the length of said sole; and means for infinitely adjusting the lateral position of said skating means throughout the length of said channel means.

9. The shoe skate of claim 8 wherein said adjusting means comprises a plurality of threaded apertures positioned within and extending along the length of said sole.

10. The shoe skate of claim 9 wherein said adjusting means further includes a slot formed in the top surface of said skating means, said slot receiving a fastener threaded into one of said apertures formed along the length of said sole.

11. The shoe skate of claim 10 wherein the length of said slot is slightly greater than the distance between said adjacent threaded apertures formed along the length of said sole.

12. The shoe skate of claim 8 wherein said rigid sole comprises a structural beam portion and a resilient sole portion molded around said beam portion.

13. A shoe skate comprising:

a foot receiving member;

a sole member attached on one surface to said foot receiving member;

a rigid structural beam embedded between said one surface of said sole member and an opposite surface thereof having a portion disposed adjacent the lower surface of said sole forming registry means extending throughout the length of said sole;

hanger means for receiving a truck and wheel assembly including a member sized to matingly engage said registry means; and means for attaching said hanger means at plural locations along the length of said registry means.

14. The shoe skate of claim 13 wherein said hanger means and said lower surface of said rigid beam include a common mating surface configuration.

15. The shoe skate of claim 13 wherein said hanger means is mounted by a single fastener to said lower surface of said rigid beam.

16. The shoe skate of claim 13 wherein said lower surface of said rigid beam includes a plurality of threaded apertures symmetrically spaced throughout its length.

17. The shoe skate of claim 16 wherein said hanger means includes an elongate slot formed along one surface thereof, the length of said slot being slightly greater than the distance between adjacent threaded apertures formed on said rigid beam to permit said hanger means to be infinitely positioned along the length of said rigid beam.

18. A sport shoe comprising:

a shoe member including an upper portion and a sole;

a rigid member extending substantially throughout the length of said sole disposed between opposite surfaces of said sole;

means disposed on the lower surface of said sole for engaging a support surface when said shoe is worn by a user; and means for mounting said engaging means at selected positions along the length of said rigid member.

19. The sport shoe of claim 18 wherein said mounting means comprises a series of apertures formed along the length of said rigid member.

20. The sport shoe of claim 18 wherein said engaging means comprises a truck and wheel assembly.

21. The sport shoe of claim 18 wherein said engaging means comprises an ice skating blade.

22. The sport shoe of claim 18 wherein said engaging means comprises a toe and heel member adapted to be received within a ski binding mounted upon a snow ski.

23. The shoe skate of claim 22 additionally comprising means removably mounted to said upper portion of said shoe to support the ankle of a user.

24. The shoe skate of claim 23 wherein said ankle support means includes a releasable snap fastener which cooperates with a mating fastener formed on said upper portion.

25. The shoe skate of claim 24 wherein said ankle support means include aperture means disposed adjacent both ends thereof to lace said support means onto said upper portion.

26. A skate shoe adapted to be worn upon the foot of a user comprising:

a shoe having a foot receiving portion and a sole portion;

a structural beam disposed entirely within the outer surfaces of said sole portion;

skating means disposed along one surface of said sole portion for contacting a support surface; and attachment means extending through a portion of said sole portion for attaching said skate means to said structural beam.

27. A skate shoe comprising:

a shoe; a wheel assembly; and means for attaching said wheel assembly on said shoe and providing infinite adjustment of said wheel assembly along the length of said shoe.

* * * * *